United States Patent [19]

Korp

[11] 4,137,582

[45] Feb. 6, 1979

[54] BED CLOTHING

[76] Inventor: Walter D. Korp, 4 A Magnolia Cir., Dade City, Fla. 33525

[21] Appl. No.: 841,048

[22] Filed: Oct. 11, 1977

[51] Int. Cl.[2] ..... A47C 23/00; A47G 9/00

[52] U.S. Cl. ..... 5/334 C; 5/343

[58] Field of Search ..... 5/334 R, 334 C, 354, 5/343

[56] References Cited

U.S. PATENT DOCUMENTS

| | | | |
|---|---|---|---|
| 3,377,636 | 4/1968 | DiAddario | 5/334 R |
| 3,381,321 | 5/1968 | DiAddario | 5/334 R |
| 3,681,795 | 8/1972 | Palenske et al. | 5/334 C |
| 4,035,854 | 7/1977 | Pardee | 5/334 C |

*Primary Examiner*—Casmir A. Nunberg

[57] ABSTRACT

A bed covering device such as a top and bottom sheet or the like is described wherein materials of proper size are combined to provide a top and bottom sheet which are attached. The bottom sheet is adapted to the contour of the mattress, forming a pocket into which the mattress fits. The top sheet is attached to the mattress pocket at the foot end so that the device can be used with either surface of the mattress.

1 Claim, 4 Drawing Figures

BED CLOTHING

This invention relates to bed clothes, and more particularily to a useful combination of top and bottom sheet which materially reduces the labor of applying the sheets to a mattress. Further the device holds the top sheet in the correct aliginment with the bottom sheet during the normal use of the bedding. Other detailed advantages will become apparent upon reading the following specifications.

Figure 2:
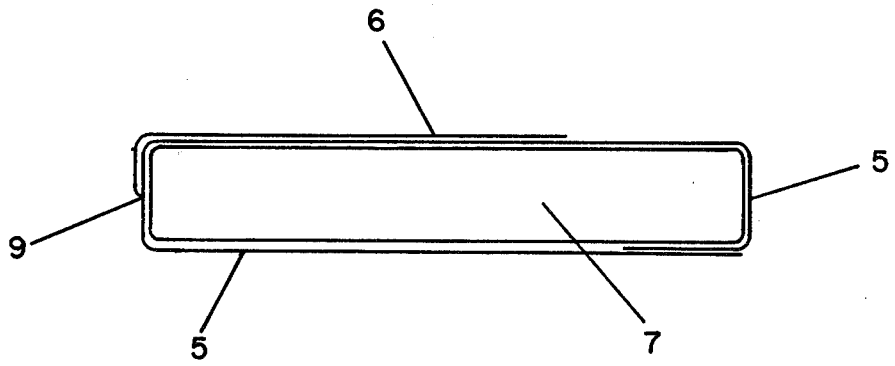
FIG. 2 is a section taken along line 2—2 of FIG. 1.
Figure 3:
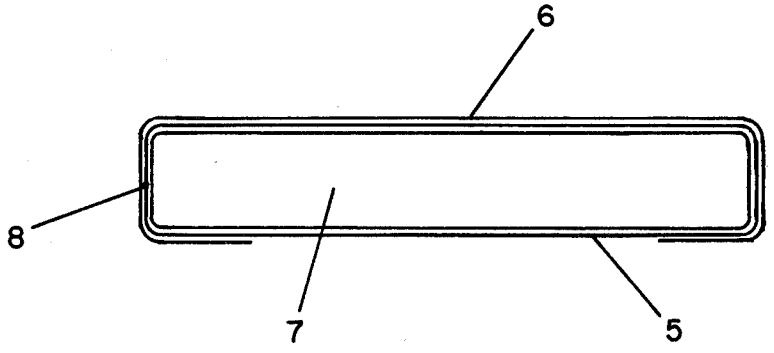
FIG. 3 is a section taken along line 3—3 of FIG. 1.
Figure 4:
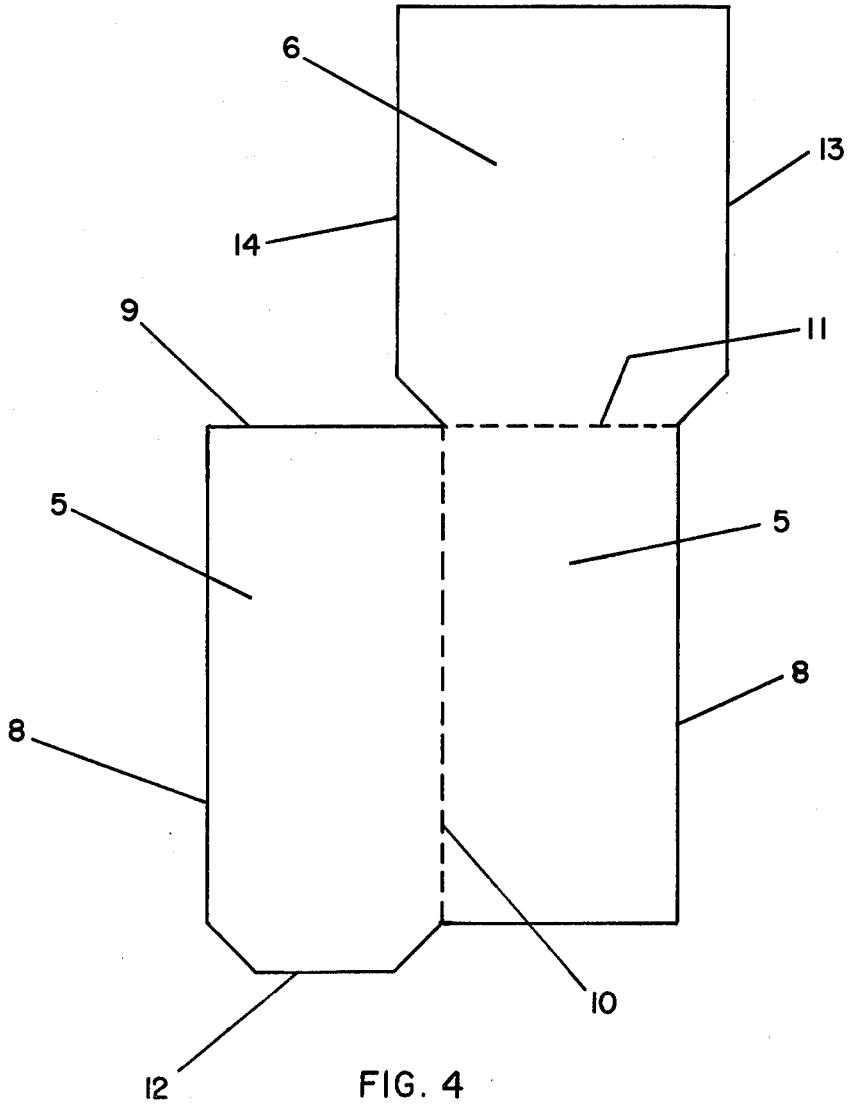
FIG. 4 is a planform of the combination top and bottom sheets made in accordance with the invention.

The invention may be embodied in bed sheets 5 and 6 on mattress 7 of FIG. 2 and FIG. 3. As depicted in FIG. 4, the invention can be made of one pre-cut sheet by folding bottom sheet 5 on line 10 and sewing or otherwise joining the sides of bottom sheet 5 on seam 8.

As shown in FIG. 4, when bottom sheet 5 is folded to form seam 8, seam 9 on one end of bottom sheet 5 can be sewen or otherwise joined to fold 11 between one half of bottom sheet 5 and top sheet 6.

The forming of seams 8 and 9 forms bottom sheet 5 into a pocket which is proportioned to fit the mattress shape.

Figure 1:
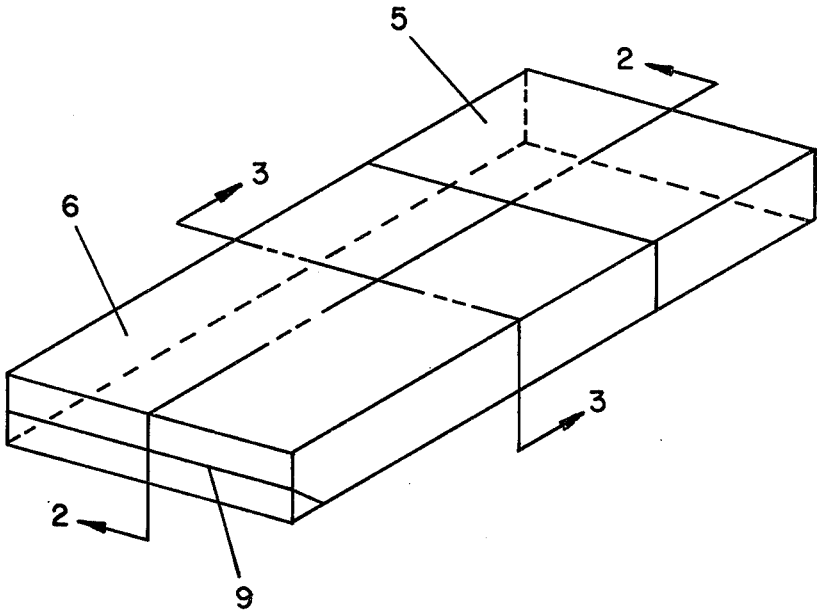
FIG. 1 is a top perspective view showing a mattress with the top and bottom sheet applied in accordance with the invention.

To make up a bed with a top and bottom sheet as shown in FIG. 4 with seams completed as outlined in previous paragraph of this specification the mattress is inserted into the bottom sheet pocket, the bottom sheet flap 12 is tucked under the mattress and the top sheet 6 is folded over the bottom sheet and the top sheet 6 side extensions 13 and 14 are tucked under the mattress as shown in FIG. 1.

Alternatively, the mattress may be placed in the pocket so that flap 12 of FIG. 4 is on the bottom of the mattress. Flap 12 is then tucked between bottom sheet 5 and the top of the mattress. In this position top sheet 6 will fold on bottom sheet 5 in the same manner as when flap 12 is on the top of the mattress.

Whereas only a few forms of the invention have been illustrated and described in detail in the body of this specification, it will be appreciated that sundry changes may be made without departing from the spirit of the invention or the scope of the following claims.

I claim:

1. In combination, a bed sheet, mattress cover construction comprising a bottom mattress cover sheet and a top mattress cover and bottom bed sheet, said sheets being joined along the bottom end and sides thereof to provide an open ended pocket adapted to receive a mattress, a top bed sheet joined along its bottom end to the bottom ends of said first mentioned sheets, said top sheet being substantially wider than the first mentioned sheets to provide top sheet edge material adapted to extend downwardly across the sides of the mattress.

* * * * *